US006439097B1

(12) United States Patent
Loving

(10) Patent No.: US 6,439,097 B1
(45) Date of Patent: Aug. 27, 2002

(54) MISSILE LAUNCHER WITH PIEZOELECTRIC LAUNCHER PULSE POWER SOURCE AND INDUCTIVE LAUNCHER/MISSILE COUPLING

(75) Inventor: Ronald E Loving, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/549,886

(22) Filed: Apr. 17, 2000

Related U.S. Application Data

(63) Continuation of application No. 09/058,109, filed on Apr. 9, 1998.

(51) Int. Cl.[7] ..... F41F 3/04
(52) U.S. Cl. ..... 89/1.814; 89/6.5; 42/210
(58) Field of Search ..... 89/1.814, 6.5; 102/209, 210; 42/84

(56) References Cited

U.S. PATENT DOCUMENTS

| | | | | |
|---|---|---|---|---|
| 3,198,074 A | | 8/1965 | Perkins | |
| 3,854,231 A | | 12/1974 | Broyles | |
| 3,982,347 A | * | 9/1976 | Brandl et al. | 42/84 |
| 4,037,517 A | | 7/1977 | Briggs et al. | |
| 4,078,327 A | | 3/1978 | Moller et al. | |
| 4,109,557 A | * | 8/1978 | Zaucha | 89/7 |
| 4,142,442 A | | 3/1979 | Tutan | |
| 4,350,096 A | * | 9/1982 | Cannavo et al. | 102/209 |
| 4,377,113 A | * | 3/1983 | Florence | 102/209 |
| 4,649,796 A | | 3/1987 | Schmidt | |
| 5,040,463 A | | 8/1991 | Beaverson | |
| 5,088,381 A | * | 2/1992 | Lamarque et al. | 89/1.814 |
| 5,343,795 A | | 9/1994 | Ziemba et al. | |

* cited by examiner

*Primary Examiner*—Michael J. Carone
*Assistant Examiner*—M. Thomson
(74) *Attorney, Agent, or Firm*—Gregory Garmong; Colin M. Raufer; Glenn H. Lenzen, Jr.

(57) ABSTRACT

A missile system includes a launcher having a built-in pulse power source and an electrical connection to a missile. The pulse power source is used to send activation and firing pulses to the missile. The pulse power source utilizes a piezoelectric crystal which produces a pulse of energy when struck by a spring-loaded hammer that is released by an operator. In one version, a first piezoelectric crystal produces a first pulse to activate the system when struck by a first hammer, and a second piezoelectric crystal produces a second pulse to fire the missile when struck by a second hammer. The energy pulses are conducted from the launcher to the missile through an inductive coupling between a primary induction coil in the launcher and a facing secondary induction coil in the missile.

19 Claims, 3 Drawing Sheets

MISSILE LAUNCHER WITH PIEZOELECTRIC LAUNCHER PULSE POWER SOURCE AND INDUCTIVE LAUNCHER/MISSILE COUPLING

This application is a continuation of pending application Ser. No. 09/058,109, filed Apr. 9, 1998, for which priority is claimed and whose disclosure is incorporated by reference.

BACKGROUND OF THE INVENTION

This invention relates to missile systems, and, more particularly, to the launching apparatus for a tube-fired missile.

Hand-carried missiles such as antitank or antiaircraft missiles are commonly stored and carried in a tubular launcher. When the missile is to be fired, the operator deploys a sight and a controller such as a handgrip trigger mechanism. To fire the missile, two distinct steps are required. In the first step, the power supply, sensor (if any), and guidance systems of the missile are activated. This activation is required because the power supply within the missile is typically a battery which is inert until activated, so that the missile may be stored for long periods of time prior to use without losing battery power. In the second step, performed after the first step is complete and the missile is active, a firing command is sent to the missile to cause its rocket motor to fire.

The inventor has recognized some shortcomings in the present launcher systems. First, although the power supply within the missile is typically normally inert and becomes activated only upon the firing of a squib, the power supply within the launch tube, which powers the signals sent to the missile, is a conventional battery which may drain or otherwise become inoperable during extended periods of storage. Battery checks of the launcher battery and replacement as necessary are therefore required for such launcher/missile systems which have been stored for a period of time. If the battery in the launcher is found to be inoperable and no replacement is readily available, the missile and launcher are inoperable.

A second problem is that the activation and firing signals are conveyed from the launcher to the missile through an umbilical which requires a secure electrical and physical connection to convey the signals, but also must have a quick and complete physical disconnection when the missile leaves the launch tube. If the electrical connection is not present, the activation and firing signals never reach the missile. The connection cannot be fully sealed, so that electrical interconnect problems may arise due to long-term corrosion effects and the like. Moreover, if the disconnection does not occur properly as the missile leaves the launch tube, the flight path of the missile may be altered so that the target is missed.

Solutions to both of these problems are needed, so as to improve the reliability of missile systems. The present invention fulfills this need, and further provides related advantages.

SUMMARY OF THE INVENTION

The present invention provides a missile system having a launcher and which may also include the missile itself. The launcher includes a self-contained pulse power source which does not utilize a battery. The launcher therefore has an indefinitely long storage life without the risk of a decline in capability. The electrical communication of the activation and firing signals from the launcher to the battery is made by a non-contacting, reliable, and secure technique. There is no concern with the long-term degradation of electrical contacts and with disconnection failures, as there is with an umbilical. The launcher power source is much less affected by environmental extremes such as high or lower temperatures, than is a conventional battery. The launcher and missile may each be made in a sealed form that resists the intrusion of external corrosion and the like into their interiors during storage. The maintainability of the launcher and the missile are thereby substantially improved, with reduced numbers of potential failure points and mechanisms, and a lower expected mean time between failures (MIBF).

In accordance with the invention, a missile system comprises a missile launcher including a pulse power source. The pulse power source comprises a piezoelectric crystal, an electrical contact to the piezoelectric crystal, and an actuatable source of a mechanical force disposed in operable relationship with the piezoelectric crystal.

The actuatable source of mechanical force preferably includes a hammer movable from a first position remote from the piezoelectric crystal to a second position in contact with the piezoelectric crystal. The force required to accomplish the movement may be provided from any operable source, but is preferably a spring biasing the hammer toward the second position with a biasing force. The actuatable source also includes a restraint holding the hammer in the first position against the biasing force of the spring, and a hammer release connected to the restraint to controllably release the restraint, thereby allowing the hammer to strike the piezoelectric crystal responsive to the biasing force of the spring. When the hammer strikes the piezoelectric crystal, there is a pulse of electrical energy whose voltage and amperage are established by the physical size of the crystal. The first pulse, which must be of relatively large amperage, is the activation pulse to activate the squib charge of the previously inert battery of the missile and otherwise bring the missile to an activated state. Other sources of force may be used, such as, for example, a cartridge that is fired by the hammer fall.

A second pulse is required to fire the engine of the missile. To produce a second, distinct pulse, it is preferred to provide a second piezoelectric crystal, a second electrical contact to the second piezoelectric crystal, and a second actuatable source of a second mechanical force disposed in operable relationship with the second piezoelectric crystal. The second actuatable source is preferably of the same hammer type as discussed previously. When the second hammer is released, it strikes the second piezoelectric crystal and produces the second, firing pulse. Other techniques for providing the second pulse may be used, such as, for example, an electrical tap of the first piezoelectric crystal and a second operation of the first hammer, or a delay circuit operating from the first pulse.

No battery is used in the launcher (although there typically is a battery in the missile itself). The energy of the electrical actuation and firing pulses is converted from mechanical force to electrical amperage by the piezoelectric crystal(s). For extreme long-term storage, there is the possibility of the biasing spring(s) losing the spring force by a creep mechanism, but this possibility may be minimized by maintaining the strain in the spring(s) well below the elastic limit or avoided entirely by leaving the spring(s) in the untensioned state during storage and providing a manual cocking mechanism that must be operated prior to activation and firing of the missile.

The activation and firing pulses are desirably transmitted from the launcher to the missile by a noncontacting approach. Preferably, the electrical pulse from the piezoelectric crystal is transmitted to a primary induction coil in the launcher, which excites a responsive electrical pulse in a secondary induction coil in the missile. The primary and secondary induction coils may be of any operable configuration. However, the launcher is typically a hollow, generally cylindrical tube which receives the generally cylindrical missile therein. The primary induction coil is most conveniently provided as one or more turns of electrical conductor wound circumferentially in the launch tube, and the secondary induction coil is one or more turns of electrical conductor wound circumferentially around the fuselage of the missile, in facing relation to the primary induction coil. With this approach, there is no physical connector required, and no concern with failure of the disconnect as the missile leaves the launcher. Moreover, the launcher body and the missile fuselage may be more completely sealed against intrusion of corrosives, dirt, and the like, than is possible with a plug-type connector, an important consideration in view of the increased longevity of the launcher with the piezoelectric pulse source.

The piezoelectric pulse source and the induction connection approaches are preferably used together. However, the piezoelectric pulse source may be used with other types of connector techniques, such as an umbilical plug connector, and the induction transmission approach may be used with other pulse sources such as battery-based sources.

The present invention provides a missile launch system of increased life and improved reliability. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
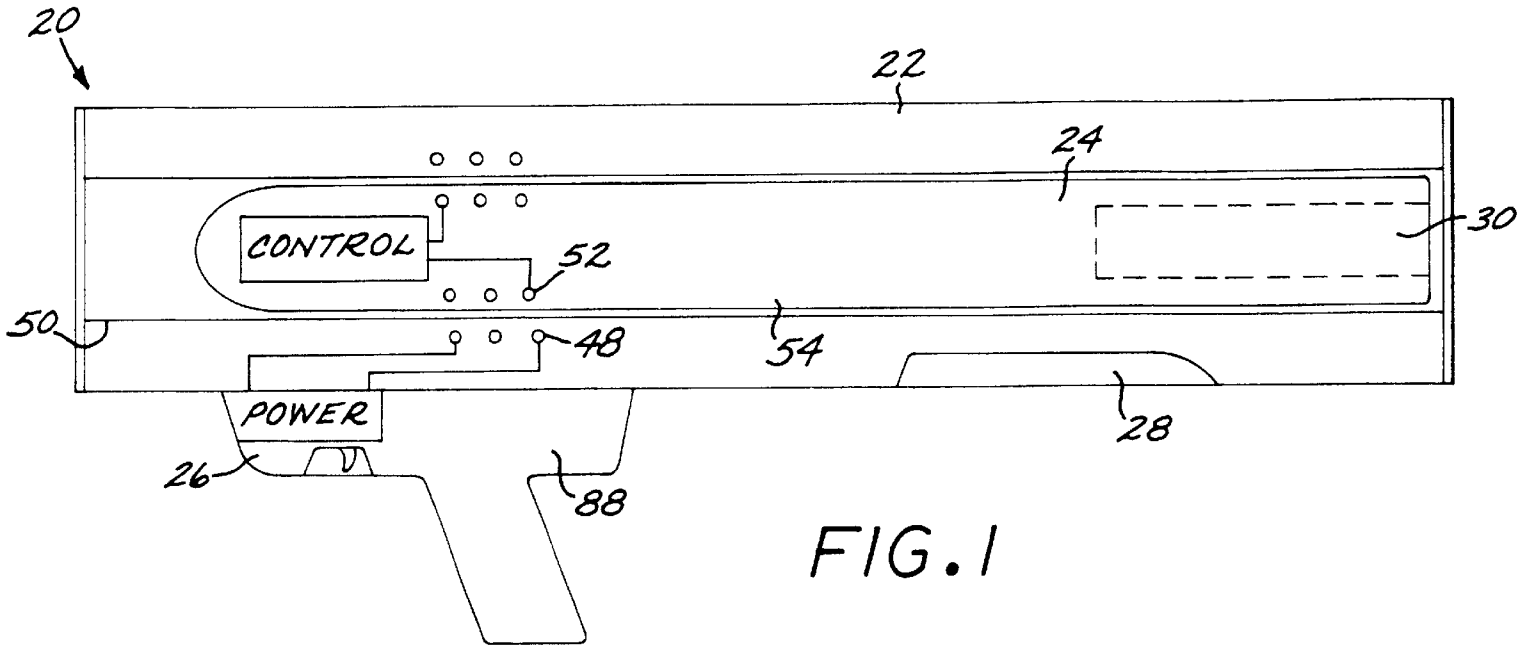
FIG. 1 is a sectional view of a launcher and a missile within the launcher.

FIG. 1 depicts a hand-carried missile system 20 according to the present invention. The missile system includes a generally cylindrical, hollow launcher tube 22 in which a generally cylindrical missile 24 is packaged and resides until launch. The launcher tube 22 has a grip/control mechanism 26 extending from the underside thereof. An operator of the missile system 20 rests a shoulder pad 28 portion of the launcher tube 22 on a shoulder and grips the grip/control mechanism 26 in one hand. To fire the missile 24 at a target, the operator sights the target through a sight (not shown) on the side or top of the launcher tube 22, and operates the firing mechanism in the manner to be described subsequently. At the completion of the launch sequence, an engine 30 of the missile 24 fires, driving the missile forwardly and out of the launcher tube 22. The missile 24 then proceeds under its own guidance or in a remotely guided mode. While the hand-carried missile system 20 is the preferred embodiment, the invention may be practiced with other types of missile systems as well such as vehicle-mounted or stationary-launcher missile systems.

The missile system 20 is built to be stored, if necessary, for long periods of time prior to use, and also to be safe for handling in field conditions. To these ends, both the launcher tube 22 and the missile 24 are fully inert until the missile system is to be used. The operation of the missile system 20 therefore requires two distinct steps in order to accomplish the firing. First, the missile 24 must be activated. In activation, an internal battery of the missile is altered from an inert state to an active state responsive to an operator-initiated signal sent from the launcher 22. Normally inert, squib-activated batteries are known in the art and are used for this application. The battery is activated to provide power for the internal systems of the missile such as its controller, guidance, sensor, etc. Once the battery is active to provide power, these other systems must also be brought to their active states. In the second step, the now-active missile is fired by sending a firing (engine ignition) signal to the motor 30, which is typically a solid rocket motor.

This two-step procedure requires that two pulse signals be sent from the launcher tube 22 to the missile 24. The power for these two pulse signals has previously been provided by a battery in the launcher tube 22. The drawback of this prior approach is that the battery has a finite life, and after long storage or during exposure to adverse conditions (i.e., extreme cold), the battery power may be insufficient to provide the two pulse signals.

Additionally, in the prior approach, the two pulse signals are transmitted from the battery in the launcher tube 22 to the missile 24 via a physical umbilical line and connector. This approach has the drawback that the interconnection can be only partially sealed against external adverse environments and also that there may be complications in accomplishing the disconnect as the missile leaves the launcher-tube.

Figure 2:
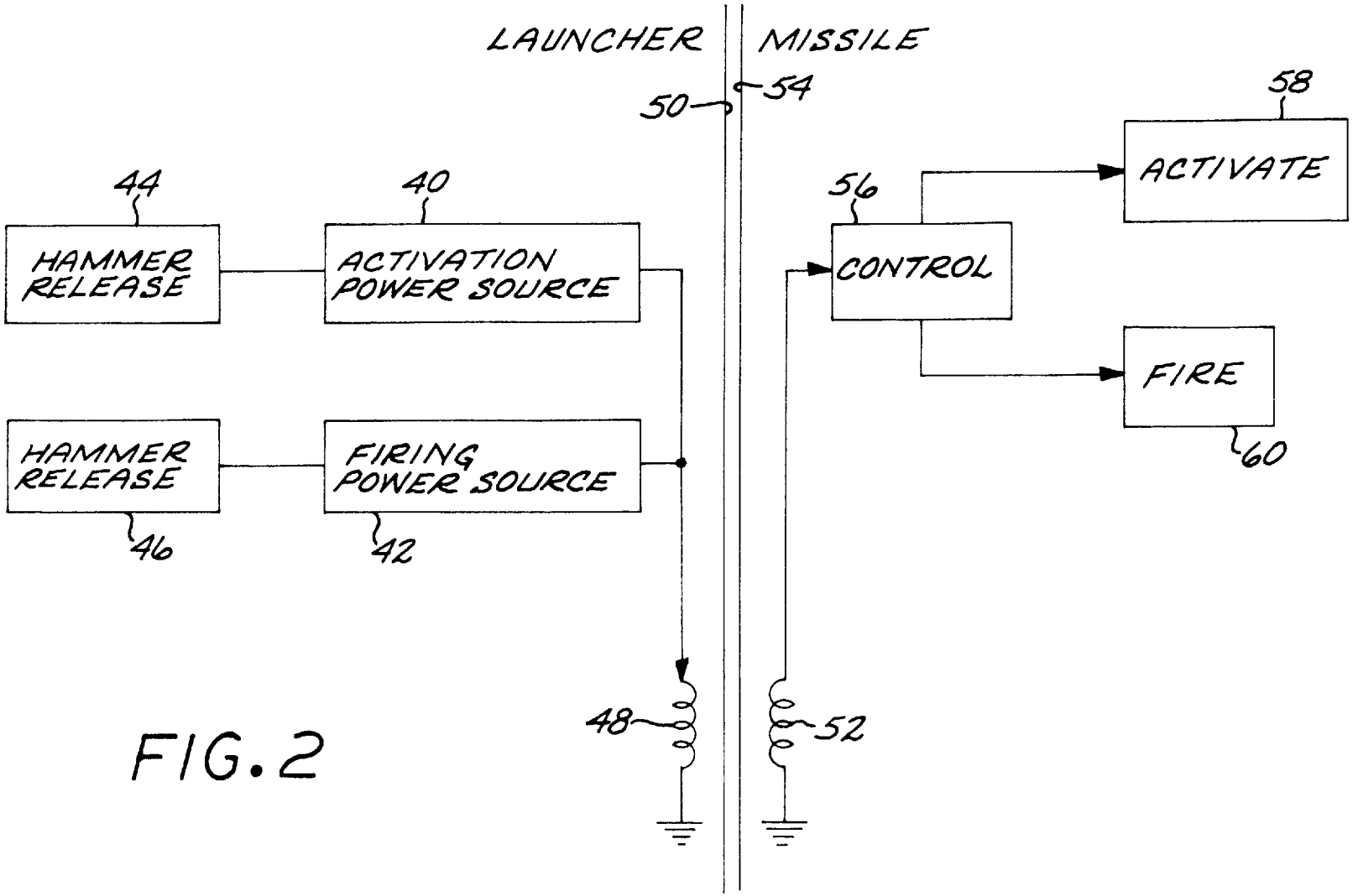
FIG. 2 is a block diagram of the launcher/missile initiation and firing circuitry.

FIG. 2 depicts the launch initiation and fire circuitry of the present invention, which overcomes these drawbacks. The pulse power for the activation and firing pulses produced in the launcher are provided by piezoelectric pulse power sources 40 and 42, respectively. The structure and operation of these piezoelectric pulse power sources 40 and 42 are discussed more fully in relation to FIGS. 3–5. The piezoelectric pulse power sources 40 and 42 are each operated by an operator-actuatable release mechanism 44 and 46, respectively.

The pulse signal outputs of the activation power source 40 and the firing power source 42 are provided to a primary induction coil 48 in the inside wall of the launcher tube 22. As shown in FIG. 1, the primary induction coil 48 is preferably at least one turn of an electrical conductor extending circumferentially around an inside wall 50 of the launcher tube 22. That is, the primary induction coil 48 is molded into the inside wall 50 of the launcher tube 22, below its surface so that it is not visible from an external view. Other operable configurations may also be used.

The pulse signal flowing in the primary induction coil 48 induces a responsive pulse in a secondary induction coil 52 within the missile 24. As shown in FIG. 1, the secondary induction coil 52 is preferably at least one turn of an electrical conductor extending circumferentially around an outer wall 54 of the missile 24. That is, the secondary induction coil 52 is molded into the outer wall 54 of the missile 24, below its surface so that it is not visible from an external view. Other operable configurations may also be used, as long as the primary and secondary induction coils are compatible. The primary induction coil 48 and the secondary induction coil 52 are-respectively positioned longitudinally along the lengths of the launcher tube 22 and the missile 24 so as to be in a generally facing relationship.

This approach has the advantage that there is no physical umbilical connection between the launcher tube 22 and the missile 24. This avoids the possibility of problems occurring in a physical disconnect at the time of firing. Additionally, the walls 50 and 54 are fully sealed against intrusion of dirt, chemicals, corrosives, and the like, further increasing the reliability of the system after long-term storage and under field conditions. The maintainability and MTBF of the missile system are thereby improved.

The pulse signal received by the secondary induction coil 52 is provided to a controller 56 in the missile 24. The controller 56 recognizes the first-transmitted pulse as the initiation pulse and utilizes activate circuitry 58 to activate the missile and bring it to a standby condition. The activate circuitry varies according to the specific missile type, but typically includes firing a missile onboard battery squib charge to energize the missile battery, sending power from the battery to a guidance system, sensor, and CPU of the missile, and performing any other activation tasks. Upon completion of the activation, the missile is ready to be fired. The controller 56 recognizes the second-transmitted pulse as the firing pulse, and sends that pulse to fire circuitry 60. The firing pulse causes the missile engine to fire, driving the missile 24 forwardly and out of the launcher tube 22.

Figure 3:
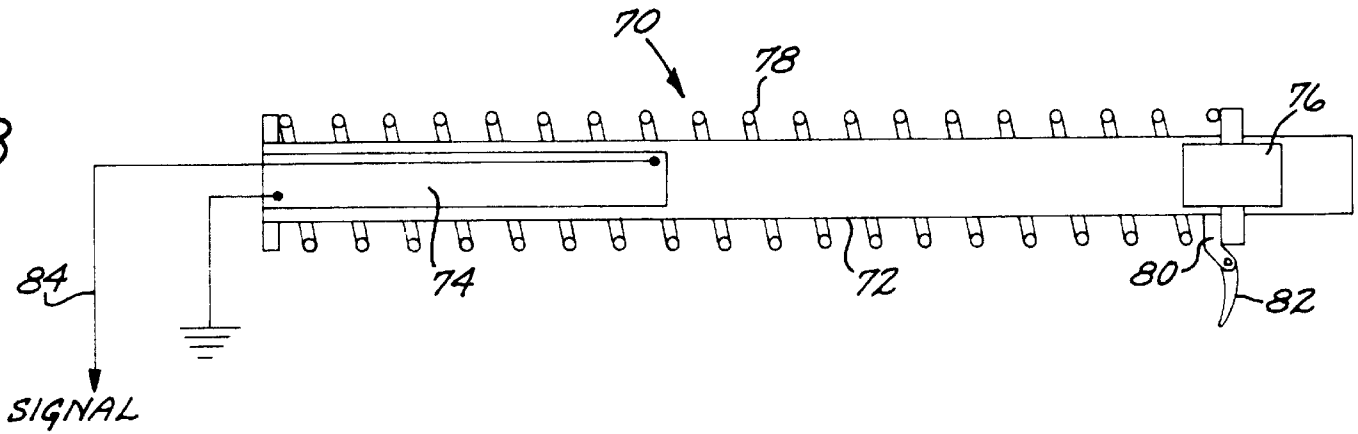
FIG. 3 is schematic drawing of a first embodiment of the piezoelectric pulse power source.
Figure 4:
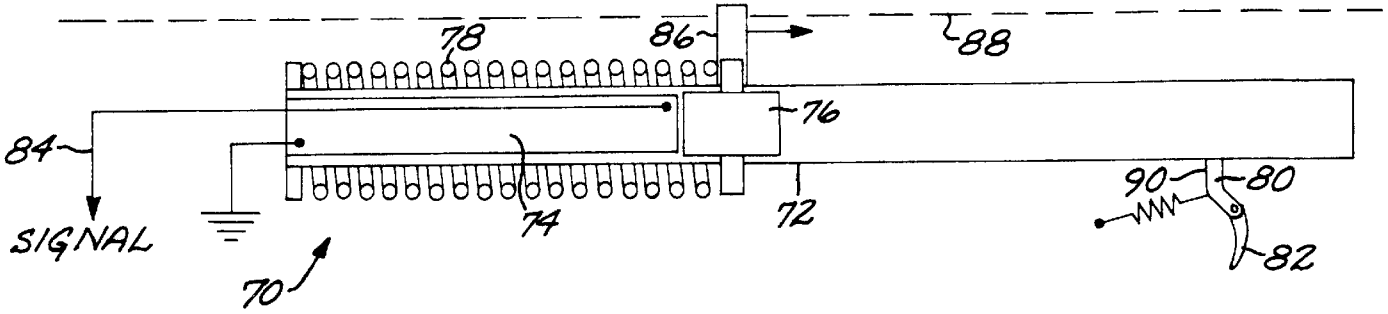
FIG. 4 is a schematic drawing of a second embodiment of the piezoelectric pulse power source.
Figure 5:
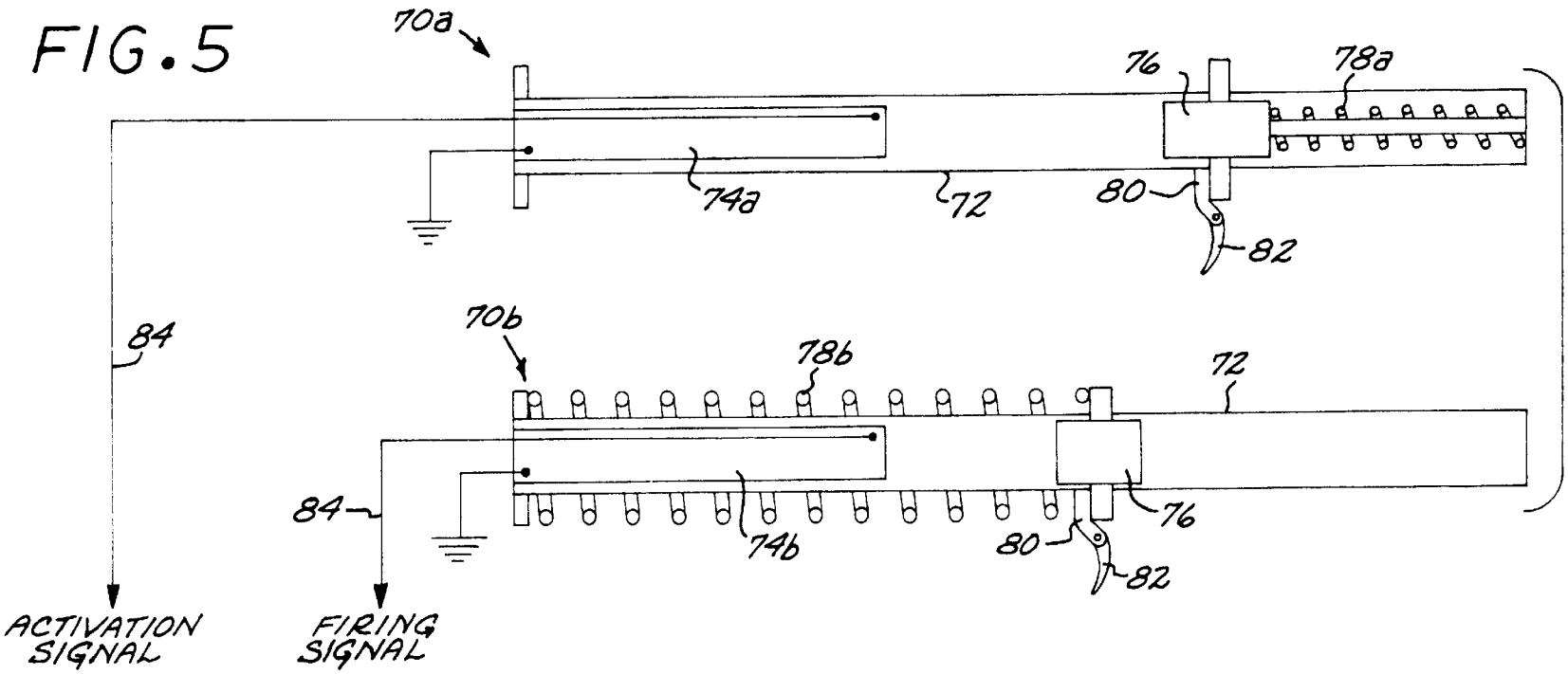
FIG. 5 is a schematic drawing of a third embodiment of the piezoelectric pulse power source.

FIGS. 3–5 illustrate three embodiments of the piezoelectric pulse power sources such as the sources 40 and 42. A power source 70 includes a housing 72 that receives, at one end, a stationary piezoelectric crystal 74. The piezoelectric crystal may be any operable piezoelectric material. The piezoelectric crystal 74 is sized to produce the required voltage and current for the pulse output desired. A hammer 76 is slidable within the housing 72.

The hammer 76 must be driven toward the piezoelectric crystal 74 with sufficient force to generate an output pulse upon striking the piezoelectric crystal. In the preferred approach for providing the force, the hammer 76 is biased toward the piezoelectric crystal 74 by a spring 78 or, equivalently, any other operable biasing means. A releasable restraint 80 holds the hammer 76 at a first position remote from, but facing an end of, the piezoelectric crystal 74. A hammer release 82, here illustrated as a trigger but which may be any other type of release mechanism, is provided. The hammer release 82 is controllably operated by the operator of the missile system 20. When the hammer release 82 is operated, the hammer 76 is driven toward the piezoelectric crystal 74 by the spring force of the spring 78. The hammer 76 strikes the piezoelectric crystal 74, causing the crystal 74 to produce a voltage pulse that is transmitted as an output signal 84 of the power source 70. The force may be provided by other means as well, such as, for example, a cartridge which, upon firing, drives the hammer forwardly.

In the embodiment of FIG. 3, the hammer is under the spring tension from the time that the launching tube assembly is fabricated until the missile is fired. It is conceivable that the spring force of the spring 78 could degrade over extended periods. The embodiment of the pulse power source 70 of FIG. 4 is comparable to that of FIG. 3, except that the hammer 76 is allowed to rest gently against the end of the piezoelectric crystal 74 during storage. As a preliminary step in the activation and firing of a missile, the hammer 76 is drawn back against the spring force of the spring 78 by a manual cocking mechanism such as a manual cocking lever 86 that extends through an outer wall 88 of the grip/control mechanism 26 so as to be accessible to the operator. The problem of weakening of the spring tension with extended storage may also be largely negated by designing the spring 78 of the embodiment of FIG. 3 so that it is loaded to about one-half or less of its yield strain and yield stress when in the extended position.

Appropriate safety mechanisms are preferably built into the power source 70. For example, there may be provided a pre-operation safety 90 that mechanically blocks the movement of the hammer release 82. The launcher may also be made safe against its post-operation use. One concern is that an unauthorized person may find a previously used and discarded launcher tube and use its pulse power source for unauthorized purposes. To prevent such unauthorized use, the spring force of the spring 78 may be made sufficiently great that the piezoelectric crystal 74 is shattered and made unusable by the impact of the hammer 76.

It will be recalled that two separate pulses of power are required in the activation and firing of the missile. The two pulses may be generated by the same hammer fall against the piezoelectric crystal, or the same hammer fall with a built-in delay line for the second pulse. However, in such an approach, the single trigger pull results in missile firing. Instead, these two pulses are preferably generated independently of each other, so that the operator has maximum control over the activation and firing steps. A preferred approach is illustrated in FIG. 5. Here, two separate piezoelectric pulse power sources 70*a* and 70*b* are provided. The elements of these power sources are as described previously except in two respects, and corresponding numerals are used here.

One difference illustrated here is that the spring 78 of FIGS. 3 and 4 is loaded in tension when the hammer is in the restrained position. To illustrate another possibility, the spring 78*a* is positioned in a compressed state when the hammer is in the restrained position. The spring 78*b*, on the other hand, is in the tensioned state as described previously.

A second difference is that the piezoelectric crystals 74*a* and 74*b* are sized differently. The voltage output of a piezoelectric crystal is a function of its length, and the amperage output is a function of its lateral size or diameter. The first power pulse to accomplish activation may require a different voltage and amperage than the second power pulse to accomplish the missile firing. The two piezoelectric crystals 74*a* and 74*b* are sized in length and diameter to provide the required pulse power levels. The different voltages and currents could also be provided by any other operable technique, such as, for example, different electrical taps of the same piezoelectric crystal, or appropriate electrical circuitry.

The various embodiments and features of FIGS. 3–5 may be used in any operable manner and combination. For example, the cocking mechanism of FIG. 4 may be used either with a tension-loaded spring as in FIG. 4 or a compression-loaded spring as in the spring 78*a* of FIG. 5.

A number of variations are within the scope of the invention, and the selection of variations will depend upon the particular circumstances governing the firing of the missile. For example, the two hammers 76 of FIG. 5 may be activated by the operation of a single trigger. A single activation/fire signal may be sent to the controller 56 of FIG. 2, rather than two separate signals as illustrated. In that case, the controller 56 contains logic that first initiates the activation circuitry 58, and, after a preselected period of time or an indication that the missile has become activated, initiates the firing 60.

The pulse power source of the invention is preferably used with an induction-coil transmission system as shown in FIG. 2, but it may be used with other types of transmission systems such as a conventional umbilical. The induction-coil transmission system is preferably used with the pulse power source, but it may be used with other types of power sources such as a conventional battery.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A missile system comprising a missile launcher including a pulse power source having a power output comprising an electrical activation pulse, the pulse power source comprising:

a piezoelectric crystal, an electrical contact to the piezoelectric crystal, and an actuatable source of a mechanical force disposed in operable relationship with the piezoelectric crystal;

a missile mechanically compatible with the launcher, the missile including a battery that is activated by the electrical activation pulse; and an electrical signal transmission system electrically communicating the power output of the pulse power source from the launcher to an electrical conductor within the missile as the electrical activation pulse.

2. The missile system of claim 1, wherein the missile launcher is in the form of a hollow tube.

3. The missile system of claim 1, wherein the missile launcher is in the form of a hollow cylindrical tube, and the missile has a generally cylindrical fuselage that is receivable into the hollow cylindrical tube.

4. The missile system of claim 1, wherein the actuatable source includes a hammer movable from a first position remote from the piezoelectric crystal to a second position in contact with the piezoelectric crystal, a spring biasing the hammer toward the second position with a biasing force, a restraint holding the hammer in the first position against the biasing force of the spring, and a hammer release connected to the restraint to controllably release the restraint, thereby allowing the hammer to strike the piezoelectric crystal responsive to the biasing force of the spring.

5. The missile system of claim 4, further including a cocking mechanism operable to move the hammer from the second position to the first position.

6. The missile system of claim 1, further including means for communicating a power output of the pulse power source to a missile contained within the missile launcher, the means for communicating including an induction coil on the launcher in facing relation to the missile contained within the missile launcher.

7. The missile system of claim 1, further including means for communicating a power output of the pulse power source to a missile contained within the missile launcher, the means for communicating including an induction coil on the launcher in facing relation to the missile contained within the missile launcher; and an induction coil on the missile in facing relation to the induction coil on the launcher.

8. The missile system of claim 1, wherein the electrical signal transmission system includes an induction coil.

9. The missile system of claim 1, wherein the pulse power source further includes a second piezoelectric crystal, a second electrical contact to the second piezoelectric crystal, and a second actuatable source of a second mechanical force disposed in operable relationship with the second piezoelectric crystal.

10. The missile system of claim 1, wherein the power output further comprises a firing pulse that sequentially follows the electrical activation pulse and is produced by the piezoelectric crystal.

11. The missile system of claim 1, wherein the power output further comprises a firing pulse that sequentially follows the electrical activation pulse and is produced by a second piezoelectric crystal.

12. A missile system, comprising:

a missile launcher including a pulse power source having a power output comprising a battery activation pulse and a separate and subsequent missile engine firing pulse;

means for communicating the power output of the pulse power source to a missile contained within the missile launcher, the means for communicating including a primary induction coil on the launcher in facing relation to the missile contained within the missile launcher; and a controller in the missile, the controller recognizing the battery activation pulse and the separate missile engine firing pulse transmitted through the means for communicating.

13. The missile system of claim 12, wherein the missile launcher is in the form of a hollow cylindrical tube, and the primary induction coil comprises at least one turn of an electrical conductor wound circumferentially around the a hollow cylindrical tube.

14. The missile system of claim 13, wherein the missile has a generally cylindrical fuselage that is receivable into the hollow cylindrical tube and the missile includes a secondary induction coil comprising at least one turn of an electrical conductor wound circumferentially around the generally cylindrical missile fuselage.

15. The missile system of claim 12, wherein the pulse power source comprises:

a piezoelectric crystal, an electrical contact between the piezoelectric crystal and the primary induction coil, and an actuatable source of a mechanical force disposed in operable relationship with the piezoelectric crystal.

16. A missile system comprising a missile launcher in the form of a hollow tube and including an activation pulse power source having an activation power output, the activation pulse power source comprising:

a piezoelectric crystal, an electrical contact to the piezoelectric crystal, and an actuatable source of a mechanical force disposed in operable relationship with the piezoelectric crystal;

a firing pulse power source having a firing power output, the firing pulse power source comprising:

a second piezoelectric crystal, a second electrical contact to the second piezoelectric crystal, and a second actuatable source of a second mechanical force disposed in operable relationship with the second piezoelectric crystal;

a missile mechanically compatible with the launcher; and an electrical signal transmission system electrically communicating the activation power output of the pulse power source and the firing power output of the firing pulse power source to the missile, wherein the electrical signal transmission system includes an induction coil.

17. A missile system, comprising:

a generally cylindrical, hollow-tube missile launcher including a pulse power source producing an activation pulse and a firing pulse, the pulse power source comprising:

a piezoelectric crystal, and an actuatable source of a mechanical force disposed in operable relationship with the piezoelectric crystal;

an electrical activation system, comprising a primary induction coil comprising at least one turn of an electrical conductor wound circumferentially around the cylindrical tube of the missile launcher, and an electrical path between the piezoelectric crystal and the primary induction coil;

a missile received within the hollow tube of the missile launcher, the missile including a battery which is activated responsive to the activation pulse and an engine which is fired responsive to the firing pulse; and a secondary induction coil comprising at least one turn of an electrical conductor wound circumferentially around a fuselage of the missile, the secondary induction coil being in a generally facing relationship to the primary induction coil when the missile is received in the launcher tube.

18. The missile system of claim 17, wherein the actuatable source includes a hammer movable from a first position remote from the piezoelectric crystal to a second position in contact with the piezoelectric crystal, a spring biasing the hammer toward the second position with a biasing force, a restraint holding the hammer in the first position against the biasing force of the spring, and a hammer release connected to the restraint to controllably release the restraint, thereby allowing the hammer to strike the piezoelectric crystal responsive to the biasing force of the spring.

19. The missile system of claim 17, further including a second piezoelectric crystal, a second electrical contact to the second piezoelectric crystal, and a second actuatable source of a second mechanical force disposed in operable relationship with the second piezoelectric crystal.

* * * * *

UNITED STATES PATENT AND TRADEMARK OFFICE

CERTIFICATE OF CORRECTION

PATENT NO. : 6,439,097 B1
DATED : August 27, 2002
INVENTOR(S) : Ronald E. Loving It is certified that error appears in the above-identified patent and that said Letters Patent is hereby corrected as shown below:

Column 1,
Line 5, insert -- This invention was made with Government support under Contract No. N60921-89-C-A139 awarded by the Department of the Navy. The Government has certain rights in this invention. --.

Signed and Sealed this

Twenty-eighth Day of September, 2004

JON W. DUDAS
*Director of the United States Patent and Trademark Office*